US006203066B1

(12) United States Patent
Lewis

(10) Patent No.: US 6,203,066 B1
(45) Date of Patent: Mar. 20, 2001

(54) FENDER SPRAY SHIELD

(76) Inventor: Edward F. Lewis, 3 Bassett Ct., Sicklerville, NJ (US) 08081

( * ) Notice: Subject to any disclaimer, the term of this patent is extended or adjusted under 35 U.S.C. 154(b) by 0 days.

(21) Appl. No.: 09/301,741

(22) Filed: Apr. 29, 1999

(51) Int. Cl.[7] ..... B05C 11/00
(52) U.S. Cl. ..... 280/851; 118/504
(58) Field of Search ..... 280/156, 851, 280/159, 160, 848, 849, 850, 288.4; 118/504, 505

(56) References Cited

U.S. PATENT DOCUMENTS 941,228 * 11/1909 Chisholm ..... 280/288.4
1,226,323 * 5/1917 Fialkowski ..... 280/288.4
4,357,898 * 11/1982 Fehrenbacher ..... 118/504
4,398,495 * 8/1983 Harris, Jr. et al. ..... 118/504
5,462,331 * 10/1995 Stief et al. ..... 296/198
5,712,170 * 1/1998 Kouvonen et al. ..... 436/518

* cited by examiner

*Primary Examiner*—Michael Mar

(57) ABSTRACT

A fender spray shield for preventing overspray onto the paint of a vehicle when tires are sprayed with a cleaning solution. The fender spray shield includes an elongate inner panel that is foldable at predetermined intervals and adapted for positioning adjacent a tire of a vehicle. The intervals define a plurality of sections that are pivotable with respect to each other. Each of the sections of the inner panel has a resiliently deformable core portion positioned between the intervals.

13 Claims, 2 Drawing Sheets

FENDER SPRAY SHIELD

BACKGROUND OF THE INVENTION

1. Field of the Invention

The present invention relates to automotive spray shield and more particularly pertains to a new fender spray shield for preventing overspray onto the paint of a vehicle when tires are sprayed with a cleaning solution.

2. Description of the Prior Art

The use of automotive spray shield is known in the prior art. More specifically, automotive spray shield heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,787,331; U.S. Pat. No. 4,436,319; U.S. Pat. No. 2,212,166; U.S. Pat. No. 4,041,999; U.S. Pat. No. 2,119,072; and U.S. Pat. No. Des. 334,682.

While these devices fulfill their respective, particular objectives and requirements, the aforementioned patents do not disclose a new fender spray shield. The inventive device includes an elongate inner panel that is foldable at predetermined intervals and adapted for positioning adjacent a tire of a vehicle. The intervals define a plurality of sections that are pivotable with respect to each other. Each of the sections of the inner panel has a resiliently deformable core portion positioned between the intervals.

In these respects, the fender spray shield according to the present invention substantially departs from the conventional concepts and designs of the prior art, and in so doing provides an apparatus primarily developed for the purpose of prevents overspray onto the paint of a vehicle when tires are sprayed with a cleaning solution.

SUMMARY OF THE INVENTION

In view of the foregoing disadvantages inherent in the known types of automotive spray shield now present in the prior art, the present invention provides a new fender spray shield construction wherein the same can be utilized for preventing overspray onto the paint of a vehicle when tires are sprayed with a cleaning solution.

The general purpose of the present invention, which will be described subsequently in greater detail, is to provide a new fender spray shield apparatus and method which has many of the advantages of the automotive spray shield mentioned heretofore and many novel features that result in a new fender spray shield which is not anticipated, rendered obvious, suggested, or even implied by any of the prior art automotive spray shield, either alone or in any combination thereof.

To attain this, the present invention generally comprises an elongate inner panel that is foldable at predetermined intervals and adapted for positioning adjacent a tire of a vehicle. The intervals define a plurality of sections that are pivotable with respect to each other. Each of the sections of the inner panel has a resiliently deformable core portion positioned between the intervals.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fender spray shield apparatus and method which has many of the advantages of the automotive spray shield mentioned heretofore and many novel features that result in a new fender spray shield which is not anticipated, rendered obvious, suggested, or even implied by any of the prior art automotive spray shield, either alone or in any combination thereof.

It is another object of the present invention to provide a new fender spray shield which may be easily and efficiently manufactured and marketed.

It is a further object of the present invention to provide a new fender spray shield which is of a durable and reliable construction.

An even further object of the present invention is to provide a new fender spray shield which is susceptible of a low cost of manufacture with regard to both materials and labor, and which accordingly is then susceptible of low prices of sale to the consuming public, thereby making such fender spray shield economically available to the buying public.

Still yet another object of the present invention is to provide a new fender spray shield which provides in the apparatuses and methods of the prior art some of the advantages thereof, while simultaneously overcoming some of the disadvantages normally associated therewith.

Still another object of the present invention is to provide a new fender spray shield for preventing overspray onto the paint of a vehicle when tires are sprayed with a cleaning solution.

Yet another object of the present invention is to provide a new fender spray shield which includes an elongate inner panel that is foldable at predetermined intervals and adapted for positioning adjacent a tire of a vehicle. The intervals define a plurality of sections that are pivotable with respect to each other. Each of the sections of the inner panel has a resiliently deformable core portion positioned between the intervals.

Still yet another object of the present invention is to provide a new fender spray shield that prevents damage to paint that could occur when harsh chemical cleaners are sprayed onto a tire and are carried by even a slight wind onto the paint.

Even still another object of the present invention is to provide a new fender spray shield that compactly folds up for convenient storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
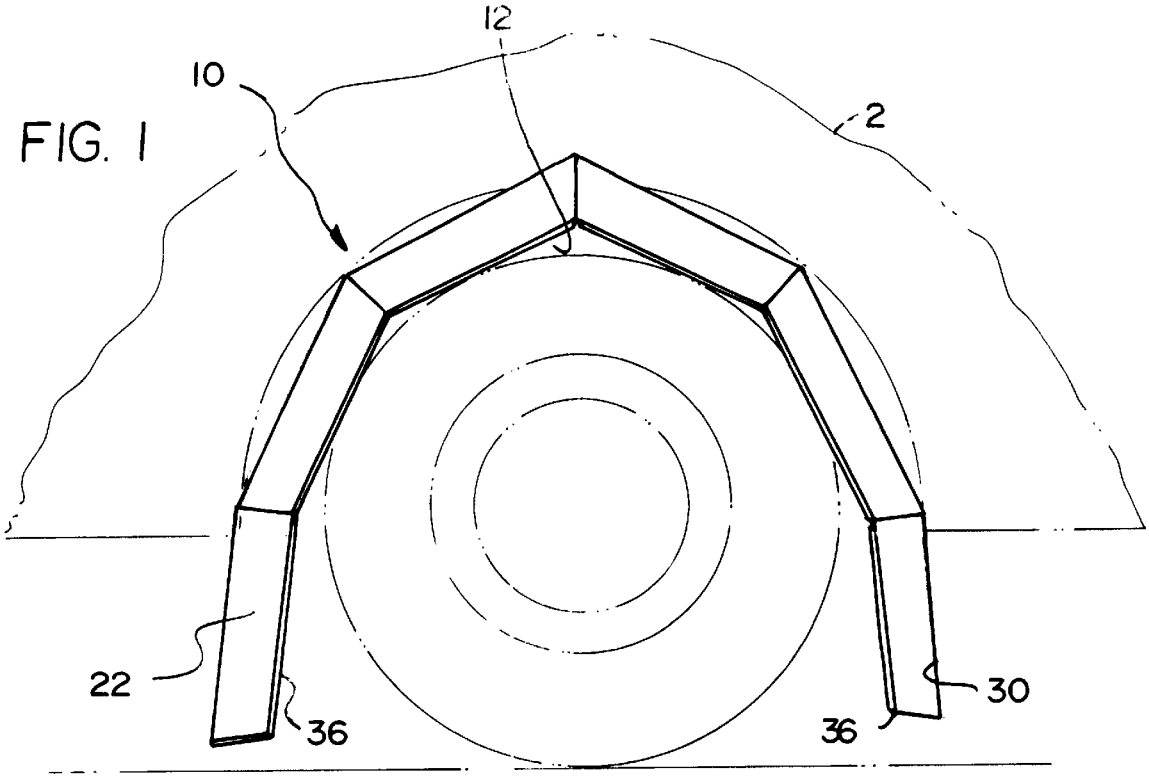
FIG. 1 is a schematic side view of a new fender spray shield according to the present invention.

With reference now to the drawings, and in particular to FIGS. 1 through 4 thereof, a new fender spray shield embodying the principles and concepts of the present invention and generally designated by the reference numeral 10 will be described.

Figure 2:
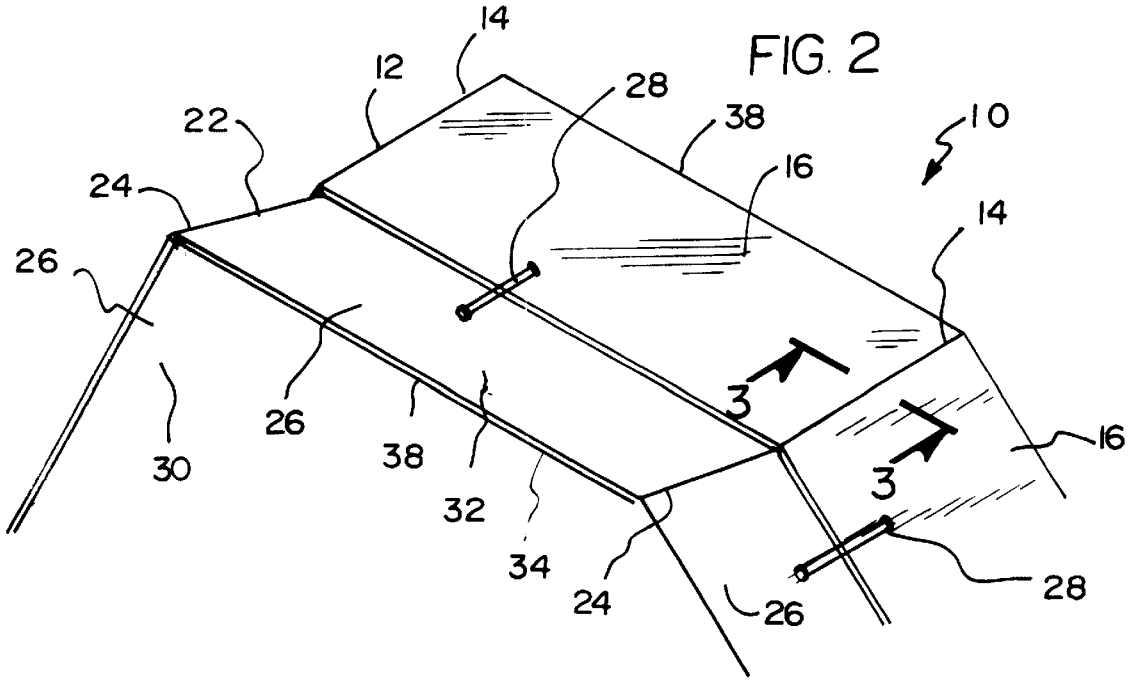
FIG. 2 is a schematic partial perspective view of the present invention.
Figure 3:
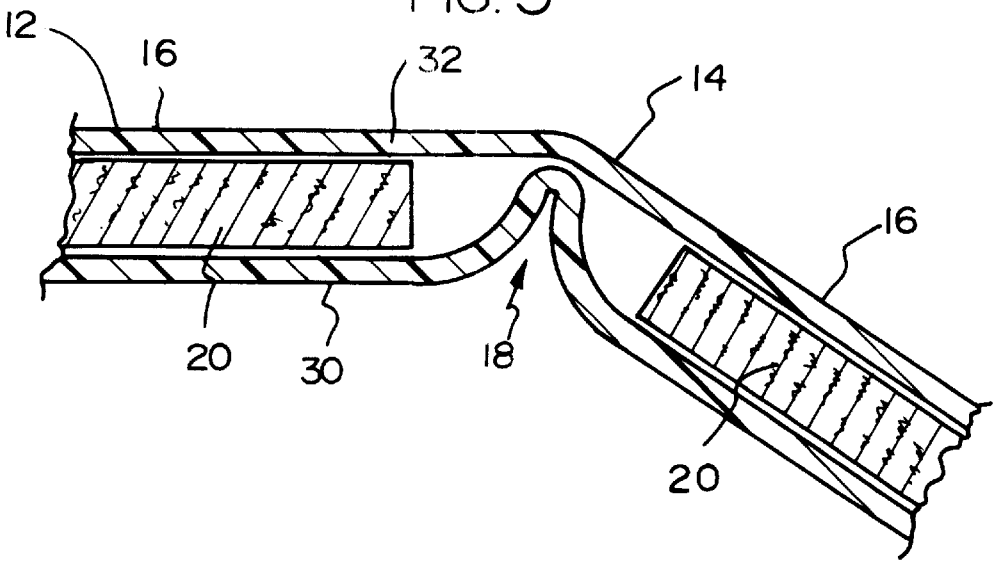
FIG. 3 is a schematic detailed cross sectional view of the present invention taken from line 3—3 of FIG. 2.

As best illustrated in FIGS. 1 through 4, the fender spray shield 10 generally comprises an elongate inner panel 12 that is foldable at predetermined intervals and adapted for positioning adjacent a tire 1 of a vehicle 2. The intervals 14 define a plurality of sections 16 that are pivotable with respect to each other. This is accomplished by a series of living hinges 18 coupling the sections together. FIG. 3 shows an exemplary living hinge. Each of the sections of the inner panel has a resiliently deformable core portion 20 positioned between the intervals.

Preferably, a portion of the inner panel drapes over and rests on the tire to support the shield off of the ground. The preferred material for the core portions is corrugated cardboard, chosen primarily because of its high strength to weight ratio.

Figure 4:
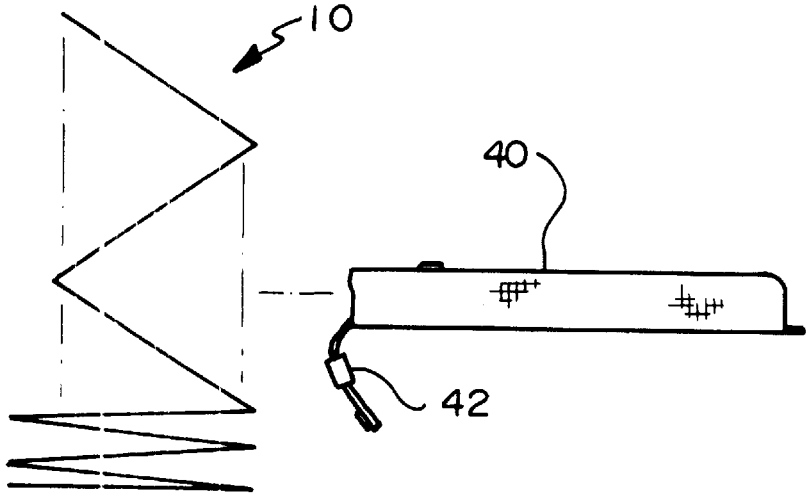
FIG. 4 is a schematic side view of the present invention illustrating how the shield folds up for storage.

Also preferably, as shown in FIG. 4, the sections of the inner panel are foldable in an accordion-like fashion into a compressed position for storage.

Preferably, as best shown in FIG. 2, an elongate outer panel 22 is pivotally coupled along its lateral edge to a lateral edge of the inner panel. The outer panel is foldable at predetermined intervals 24 coinciding with the intervals of the inner panel. The intervals of the outer panel define a plurality of sections 26 that are pivotable with respect to each other. This is accomplished by a series of living hinges coupling the sections together.

Ideally, each of the sections of the outer panel has a resiliently deformable core portion (not shown) positioned between the intervals. The preferred material for the core portions of the outer panel is also corrugated cardboard, chosen primarily because of its light weight.

The outer panel is pivotable between a deployed position and a retracted position. The outer panel is positioned away from an upper surface of the inner panel (i.e., it is unfolded) when the outer panel is in the deployed position, as illustrated in FIG. 2. The outer panel is folded onto the inner panel when the outer panel is positioned in the retracted position.

Ideally, a plurality of support straps 28 extend between the sections of the inner and outer panels. The support straps limit the sections of the outer panel to a position at an angle of less than about 140 degrees from an upper surface of adjacent sections of the inner panel when the outer panel moves towards the deployed position. Each adjacent pair of sections needs only one support strap, but more may be provided.

The sections of the outer panel are foldable with the sections of the inner panel in an accordion-like fashion for storage when the outer panel is in the retracted position.

Preferably, a chemically inert inner covering 30 extends along an inner surface of the inner panel and an inner surface of the outer panel to protect the core portions of the sections of the panels from contact with a cleaning solution sprayed on the tires. More preferably, a chemically inert outer covering 32 is sealed with the inner covering along an outer peripheral edge 34 of the inner covering to protect the core portions of the sections of the inner and outer panels from contact with the cleaning solution as well as make the whole apparatus weatherproof.

Optionally, the inner and outer coverings may form the living hinges between the sections and between the panels. In such an embodiment, the core portions of the panels are fastened to the inner and outer coverings.

The preferred dimensions of a spray shield for a vehicle with standard 14 to 17 inch (inner diameter) tires is between about 70 and 85 inches long between opposite ends 36 of the panels, ideally about 74¼ inches long. This length permits spraying of the tire from top to bottom without spray flying underneath the panels and onto the vehicle paint. The preferred width of each panel between opposite lateral edges 38 thereof is between about 5 and 8 inches (or between about 10 and 16 inches total for both panels together lying flat and unfolded), ideally about 6½ inches (or about 13 inches total for both panels together lying flat and unfolded). The preferred length of each section along a longitudinal axis of the associated panel is about 12⅜ inches.

Preferably, a protective case 40 receives the spray shield when folded into the compressed position for storage. Ideally, an inner surface of the protective case comprises a chemically inert material so that the harsh tire cleaning chemicals still on the panels don't damage the protective case. Also ideally, the protective case has resilient walls for protecting the panels from being crushed, especially when stored in a trunk of a car. The protective case has an overlapping lid portion 42 for closing an opening into the protective case to provide maximum protection from leakage and to help prevent chemical fumes from escaping from the protective case.

In use, the spray shield is removed from the protective case and unfolded. The outer panel is positioned in the deployed position. The inner panel is draped over the tire as shown in FIG. 1 with the outer panel extending away from the vehicle. Then the tire is cleaned with a cleaner. The spray shield helps prevent spray cleaners from misting and overspraying onto the paint of the vehicle. The spray shield also helps prevent splashing of cleaning solutions onto the vehicle paint when scrubbing the tires with a brush. When done cleaning the tires, the spray shield is folded into the compressed position and reinserted in the protective case for storage.As to a further discussion of the manner of usage and operation of the present invention, the same should be apparent from the above description. Accordingly, no further discussion relating to the manner of usage and operation will be provided.With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:1. A spray shield, comprising:

an elongate inner panel being foldable at predetermined intervals and adapted for positioning adjacent a tire of a vehicle;

said intervals defining a plurality of sections being pivotable with respect to each other; and each of said sections of said inner panel having a resiliently deformable core portion positioned between said intervals;

an elongate outer panel being pivotally coupled along a lateral edge thereof to a lateral edge of said inner panel, said outer panel being foldable at predetermined intervals coinciding with said intervals of said inner panel, said intervals of said outer panel defining a plurality of sections being pivotable with respect to each other, and said outer panel being pivotable between a deployed position and a retracted position, said outer panel being positioned away from said inner panel when said outer panel is in said deployed position, said outer panel being folded onto said inner panel when said outer panel is positioned in said retracted position;

a plurality of support straps extending between said sections of said inner and outer panels, said support straps being for limiting pivotal movement of said sections of said outer panel to a position at an angle of less than about 140 degrees between upper surfaces of adjacent sections of said inner and outer panels when said outer panel moves towards said deployed position;

wherein each of said sections of said outer panel has a resiliently deformable core portion positioned between said intervals.2. The spray shield of claim 1, wherein said sections of said inner panel are foldable in an accordion-like fashion into a compressed position for storage.3. The spray shield of claim 2, further comprising an elongate outer panel being pivotally coupled along a lateral edge thereof to a lateral edge of said inner panel, said outer panel being foldable at predetermined intervals coinciding with said intervals of said inner panel, said intervals of said outer panel defining a plurality of sections being pivotable with respect to each other, said sections of said outer panel being foldable with said sections of said inner panel in an accordion-like fashion for storage when said outer panel is in said retracted position.4. The spray shield of claim 2, further comprising a protective case for receiving said inner panel when folded into said compressed position.5. The spray shield of claim 4, wherein an inner surface of said protective case comprising a chemically inert material.6. The spray shield of claim 4, wherein said protective case has resilient walls for protecting said panels from crushing.7. The spray shield of claim 4, wherein said protective case has an overlapping lid portion for closing an opening into said protective case.8. The spray shield of claim 1, further comprising a chemically inert inner covering extending along an inner surface of said inner panel for protecting said core portions of said sections of said inner panel from contact with a cleaning solution.9. The spray shield of claim 8, further comprising a chemically inert outer covering being sealed with said inner covering along an outer peripheral edge of said inner covering for protecting said core portions of said sections of said inner and outer panels from contact with a cleaning solution.10. The spray shield of claim 1, further comprising a chemically inert inner covering extending along an inner surface of said inner panel and an inner surface of said outer panel for protecting said core portions of said sections of said panels from contact with a cleaning solution.11. The spray shield of claim 10, further comprising a chemically inert outer covering being sealed with said inner covering along an outer peripheral edge of said inner covering for protecting said core portions of said sections of said inner and outer panels from contact with a cleaning solution.12. A spray shield, comprising:

an elongate inner panel being foldable at predetermined intervals and adapted for positioning adjacent a tire of a vehicle;

said intervals defining a plurality of sections being pivotable with respect to each other;

each of said sections of said inner panel having a resiliently deformable core portion positioned between said intervals;

said sections of said inner panel being foldable in an accordion-like fashion into a compressed position for storage;

an elongate outer panel being pivotally coupled along a lateral edge thereof to a lateral edge of said inner panel;

said outer panel being foldable at predetermined intervals coinciding with said intervals of said inner panel, said intervals of said outer panel defining a plurality of sections being pivotable with respect to each other;

each of said sections of said outer panel having a resiliently deformable core portion positioned between said intervals;

said outer panel being pivotable between a deployed position and a retracted position, said outer panel being positioned away from said inner panel when said outer panel is in said deployed position, said outer panel being folded onto said inner panel when said outer panel is positioned in said retracted position;

a plurality of support straps extending between said sections of said inner and outer panels, said support straps being for limiting pivotal movement of said sections of said outer panel to a position at an angle of less than about 140 degrees between upper surface of adjacent sections of said inner panel when said outer and outer panels moves towards said deployed position;

said sections of said outer panel being foldable with said sections of said inner panel in an accordion-like fashion for storage when said outer panel is in said retracted position;

a chemically inert inner covering extending along an inner surface of said inner panel and an inner surface of said outer panel for protecting said core portions of said sections of said panels from contact with a cleaning solution;

a chemically inert outer covering being sealed with said inner covering along an outer peripheral edge of said inner covering for protecting said core portions of said sections of said inner and outer panels from contact with a cleaning solution; and said inner and outer coverings forming living hinges between said sections and between said panels.13. The spray shield of claim 12, further comprising a protective case for receiving said panels when folded into said compressed position;

an inner surface of said protective case comprising a chemically inert material;

said protective case having resilient walls for protecting said panels from crushing; and said protective case having an overlapping lid portion for closing an opening into said protective case.

* * * * *